US012398920B2

(12) United States Patent
Wilson et al.

(10) Patent No.: US 12,398,920 B2
(45) Date of Patent: Aug. 26, 2025

(54) HVAC SYSTEM WITH BAFFLES

(71) Applicant: Johnson Controls Tyco IP Holdings LLP, Milwaukee, WI (US)

(72) Inventors: Stephen C. Wilson, Oklahoma City, OK (US); Sumedh J. Suryawanshi, Pune (IN); Amit R. Chothave, Nashik (IN); Karan Garg, Pune (IN)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/369,663

(22) Filed: Sep. 18, 2023

(65) Prior Publication Data

US 2024/0003593 A1 Jan. 4, 2024

Related U.S. Application Data

(63) Continuation of application No. 16/689,843, filed on Nov. 20, 2019, now Pat. No. 11,761,679.

(51) Int. Cl.

| | |
|---|---|
| ***F24H 3/08*** | (2022.01) |
| ***F24H 9/00*** | (2022.01) |
| ***F24H 9/1881*** | (2022.01) |

(52) U.S. Cl.

CPC ..... *F24H 3/087* (2013.01); *F24H 9/0063* (2013.01); *F24H 9/1881* (2013.01)

(58) Field of Classification Search

None

See application file for complete search history.

(56) References Cited

U.S. PATENT DOCUMENTS

| | | | | |
|---|---|---|---|---|
| 4,622,947 | A * | 11/1986 | Hays | F24H 3/087 237/55 |
| 5,347,980 | A | 9/1994 | Shellenberger | |
| 9,797,617 | B2 | 10/2017 | Bicknell | |
| 2016/0131395 | A1 | 5/2016 | Wagers et al. | |
| 2016/0288618 | A1 | 10/2016 | Katoh et al. | |
| 2017/0326966 | A1 * | 11/2017 | Marcant | F01P 3/18 |
| 2018/0216850 | A1 * | 8/2018 | Lemon | F24H 9/0063 |
| 2020/0033027 | A1 | 1/2020 | Kim et al. | |

FOREIGN PATENT DOCUMENTS

| | | | |
|---|---|---|---|
| CN | 201326522 | Y | 10/2009 |
| KR | 101567632 | B1 | 1/2015 |
| KR | 101684086 | B1 | 10/2016 |

* cited by examiner

*Primary Examiner* — Jason Lau
(74) *Attorney, Agent, or Firm* — Fletcher Yoder, PC

(57) ABSTRACT

A furnace for a heating, ventilation, and/or air conditioning (HVAC) system includes a first set of heat exchanger tubes positioned within an air flow path of the furnace through which an air flow may be directed, a second set of heat exchanger tubes positioned within the air flow path of the furnace, and a deflector baffle positioned within the air flow path and configured to direct a portion of the air flow toward the second set of heat exchanger tubes. The first set of heat exchanger tubes, the deflector baffle, and the second set of heat exchanger tubes are each respectively offset from one another in a direction of the air flow along the air flow path.

16 Claims, 10 Drawing Sheets

HVAC SYSTEM WITH BAFFLES

CROSS-REFERENCE TO RELATED APPLICATIONS

This is a continuation application of U.S. patent application Ser. No. 16/689,843, entitled "HVAC SYSTEM WITH BAFFLES," filed Nov. 20, 2019, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light, and not as admissions of prior art.

HVAC systems are utilized in residential, commercial, and industrial environments to control environmental properties, such as temperature and humidity, for occupants of the respective environments. An HVAC system may control the environmental properties through control of an air flow delivered to the environment. For example, the HVAC system may circulate a refrigerant and place the refrigerant in a heat exchange relationship with a supply air flow to condition the supply air flow before it is discharged to the conditioned environment. In some embodiments, the HVAC system includes a heat exchanger through which the refrigerant or other working fluid flows. For example, the heat exchanger may be a furnace configured to direct combustion products through tubes of the furnace. The supply air flow may be directed over the heat exchanger to exchange heat with the refrigerant or other working fluid. However, in some instances, a portion of the supply air flow may not flow directly across or through the heat exchanger. As such, an amount of heat exchanged between the supply air flow and the refrigerant or working fluid is reduced, thereby impacting a performance, such as an efficiency, of the HVAC system to condition the supply air flow.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a furnace for a heating, ventilation, and/or air conditioning (HVAC) system includes a first set of heat exchanger tubes positioned within an air flow path of the furnace through which an air flow may be directed, a second set of heat exchanger tubes positioned within the air flow path of the furnace, and a deflector baffle positioned within the air flow path and configured to direct a portion of the air flow toward the second set of heat exchanger tubes. The first set of heat exchanger tubes, the deflector baffle, and the second set of heat exchanger tubes are each respectively offset from one another in a direction of the air flow along the air flow path.

In one embodiment, a furnace for a heating, ventilation, and/or air conditioning (HVAC) system includes a first set of heat exchanger tubes positioned within an air flow path of the furnace through which an air flow may be directed, a second set of heat exchanger tubes positioned within the air flow path of the furnace and a deflector baffle positioned within the air flow path and between the first set of heat exchanger tubes and the second set of heat exchanger tubes relative to a direction of the air flow through the furnace.

In one embodiment, a furnace for a heating, ventilation, and/or air conditioning (HVAC) system includes a first set of heat exchanger tubes configured to heat an air flow, a second set of heat exchanger tubes configured to further heat the air flow, and a baffle positioned between the first set of heat exchanger tubes and the second set of heat exchanger tubes along a direction of the air flow through the furnace. The baffle has a deflecting surface configured to direct the air flow from the first set of heat exchanger tubes toward the second set of heat exchanger tubes.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
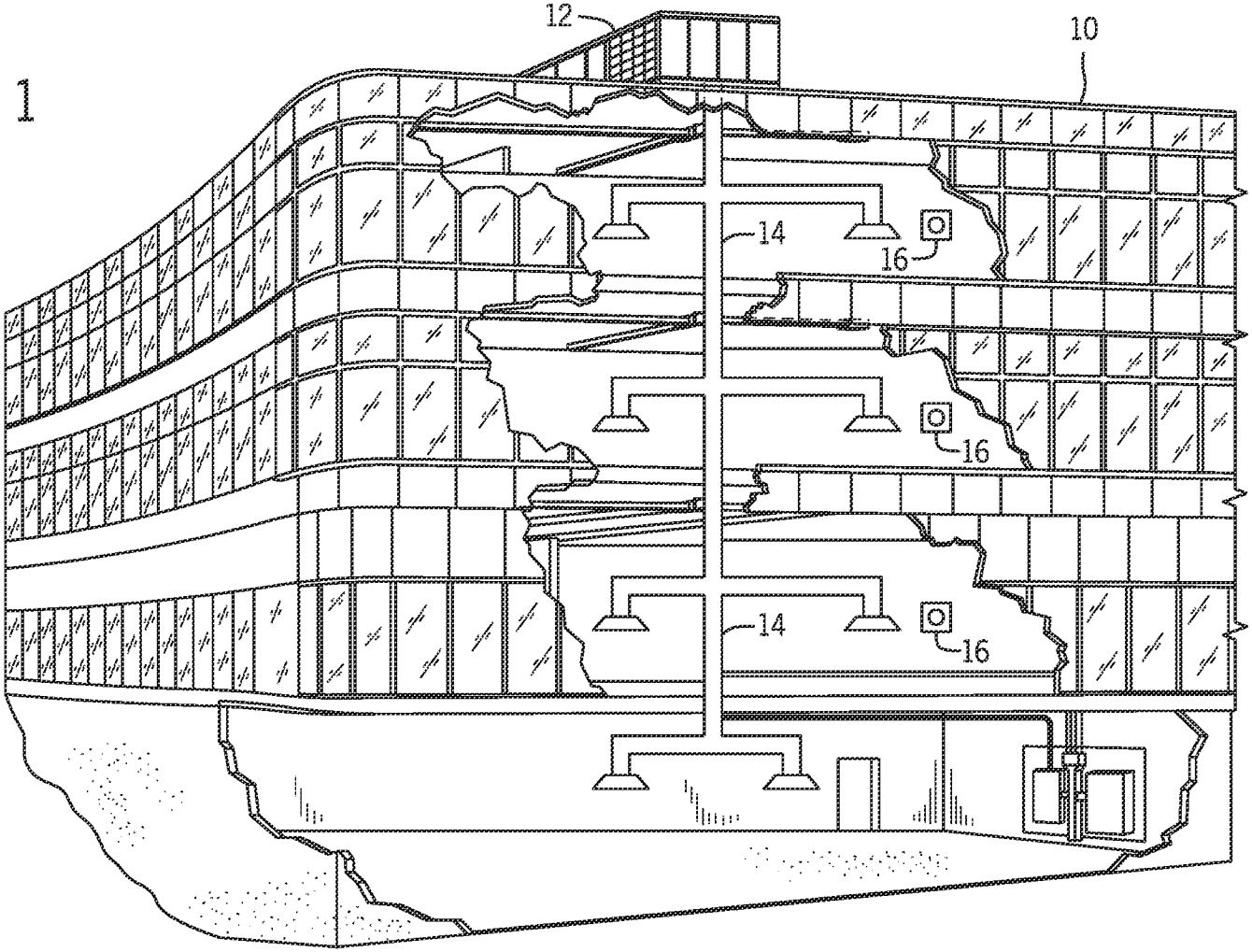
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system having a section or chamber that includes a heat exchanger through which a working fluid is configured to flow. For example, the heat exchanger may be a furnace, and the working fluid may be combustion products. An air flow may be directed through the section to exchange heat with the working fluid, thereby conditioning the air flow. In some embodiments, the heat exchanger includes a first set of heat exchanger tubes and a second set of heat exchanger tubes positioned in series relative to a direction of the air flow through the section. In an embodiment in which the heat exchanger is a furnace of the HVAC system, heat from combustion products within the heat exchanger may transfer to the air flow to increase the temperature of the air flow. As such, the air flow may flow across the first set of heat exchanger tubes and exchange heat with the working fluid to heat the air flow, and the air flow may then flow across the second set of heat exchanger tubes and exchange heat with the working fluid to further heat the air flow.

In some instances, the air flow directed through the section does not directly flow across the heat exchanger. As an example, a portion of the air flow may flow around or to the side of the first and/or the second set of heat exchanger tubes, rather than across the first and/or the second set of heat exchanger tubes. Thus, the portion of the air flow may not exchange heat with the working fluid flowing through the heat exchanger tubes. As a result, an amount of heat exchanged between the working fluid and the air flow may be reduced, thereby causing insufficient conditioning of the air flow and/or inefficient operation of the HVAC system.

Thus, it is now recognized that directing the air flow to flow directly across the heat exchanger may increase the amount of heat exchanged between the working fluid and the air flow. Accordingly, embodiments of the present disclosure are directed to baffles or baffle plates positioned within the section so as to direct the air flow across the heat exchanger tubes. In some embodiments, the baffles are positioned between the first and second set of heat exchanger tubes and may guide the air flow from the first set of heat exchanger tubes to the second set of heat exchanger tubes. For instance, the baffles may be attached to respective walls of the section and may extend toward the second set of heat exchanger tubes to form an opening or flow path that directs the air flow toward the second set of heat exchanger tubes. As a result, the air flow may move through the opening and directly across the second set of heat exchanger tubes. For this reason, the baffles may increase the amount of heat exchanged between the air flow and the working fluid flowing through the second set of heat exchanger tubes, thereby improving a performance of the HVAC system to condition the air flow. Although the present disclosure primarily discusses implementation of the baffles within a furnace configured to increase the temperature of the air flow, the baffles may be disposed within any suitable section or chamber of the HVAC system through which the air flow is directed to guide the air flow through the section in a desirable manner.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
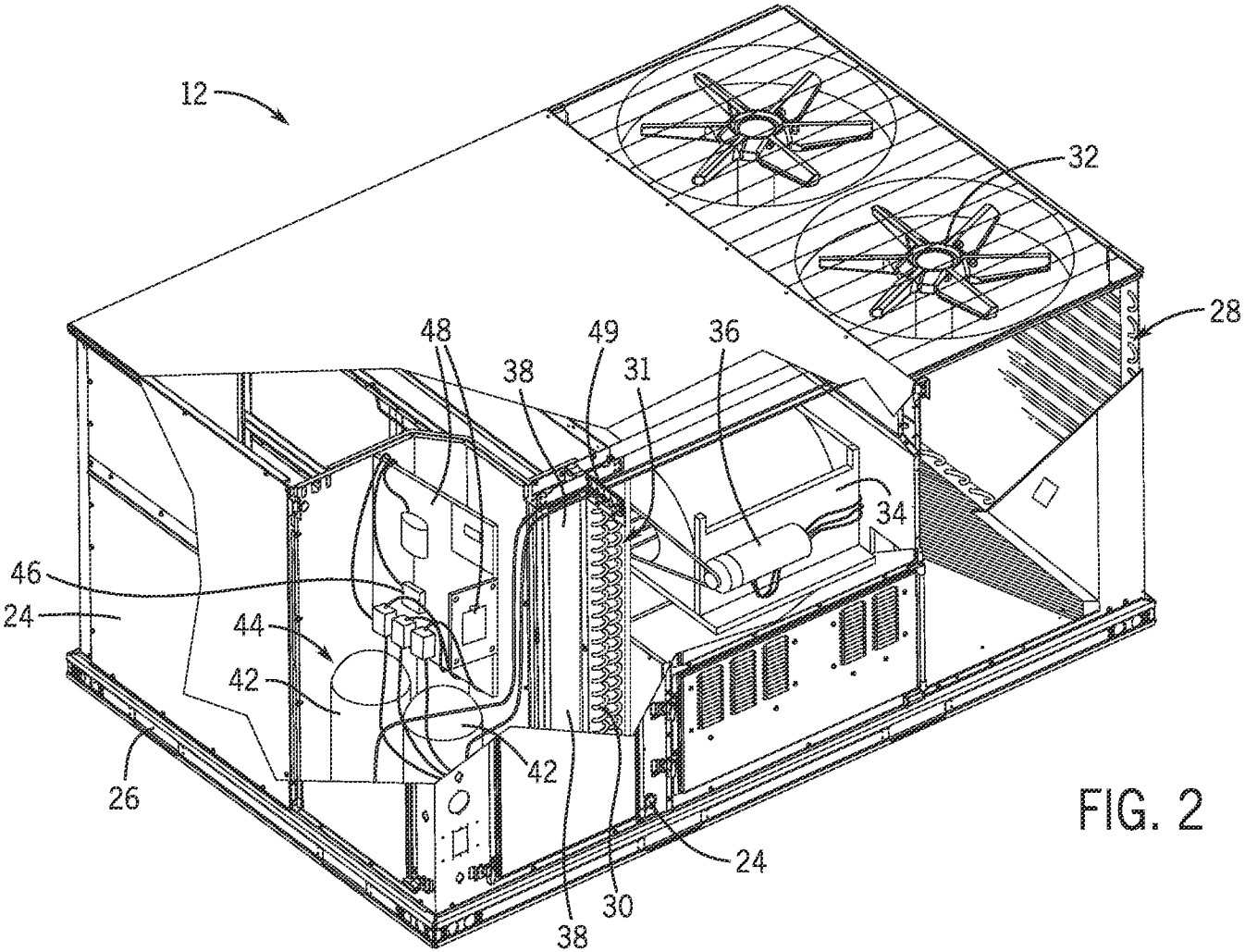
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be noted, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
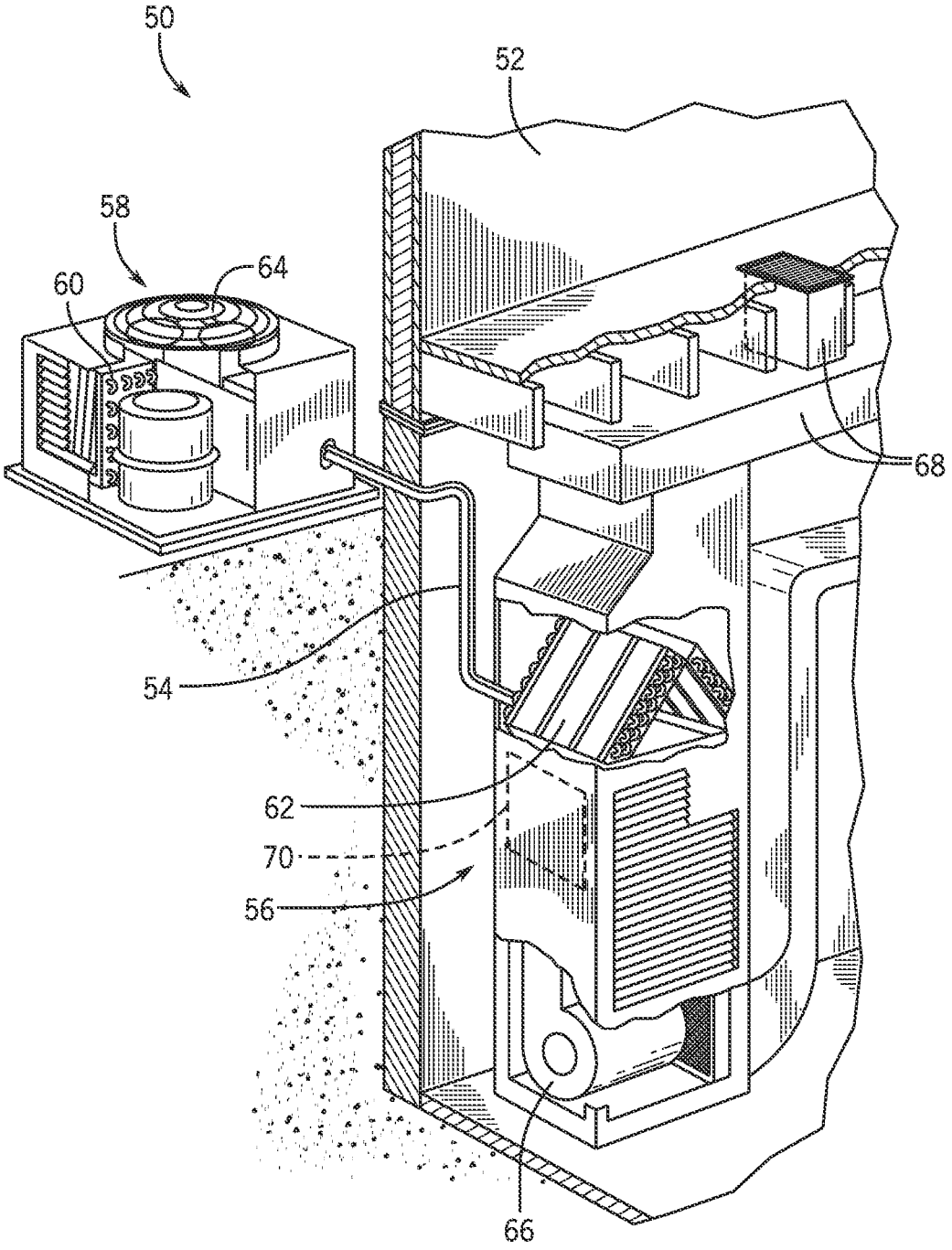
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
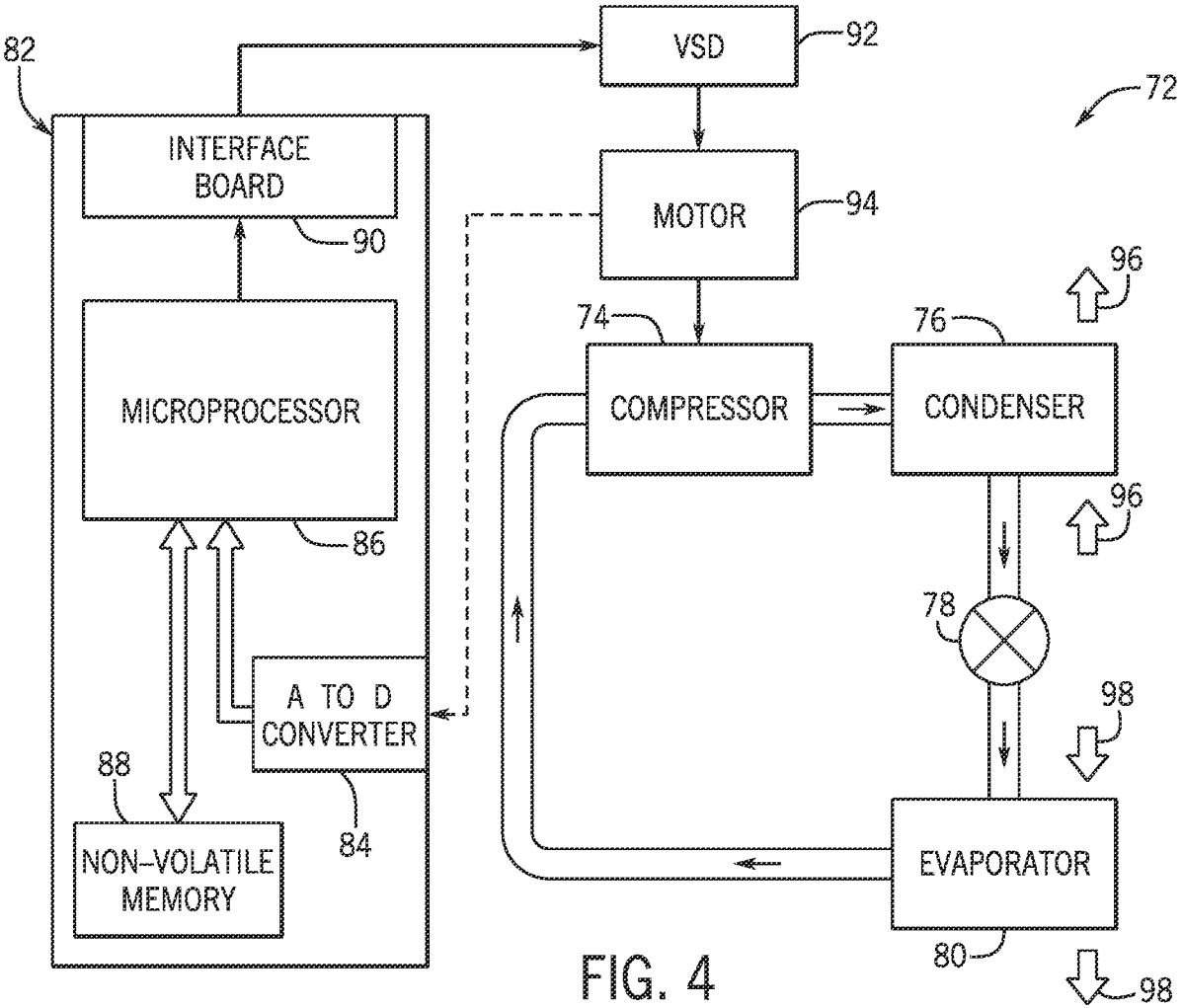
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be noted that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system may have multiple sections and/or chambers. As used herein, a section or chamber of the HVAC system or unit may be any suitable volume or enclosure of the HVAC system through which an air flow is directed. For example, the section may have heat exchanger tubes through which a working fluid flows. The air flow may be directed through the section and across the heat exchanger tubes, thereby exchanging heat with the working fluid. The section may also include baffles configured to direct the air flow directly across the heat exchanger tubes to enable a greater amount of heat exchange between the air flow and the working fluid. In some embodiments, the section may include a first set of heat exchanger tubes and a second set of heat exchanger tubes. The baffles may extend generally between the first set of heat exchanger tubes and the second set of heat exchanger tubes along a flow direction of the air flow. In particular, the baffles may be arranged so as to block the air flow from bypassing the second set of heat exchanger tubes and/or to guide the air flow from the first set of heat exchanger tubes to the second set of heat exchanger tubes. Thus, the baffles may increase an amount of the air flow directed across the second set of heat exchanger tubes, thereby increasing an amount of heat exchanged between the air flow and the working fluid directed through the second set of heat exchanger tubes. As a result, the baffles may improve a performance, such as an efficiency, of the HVAC system to condition the air flow.

Figure 5:
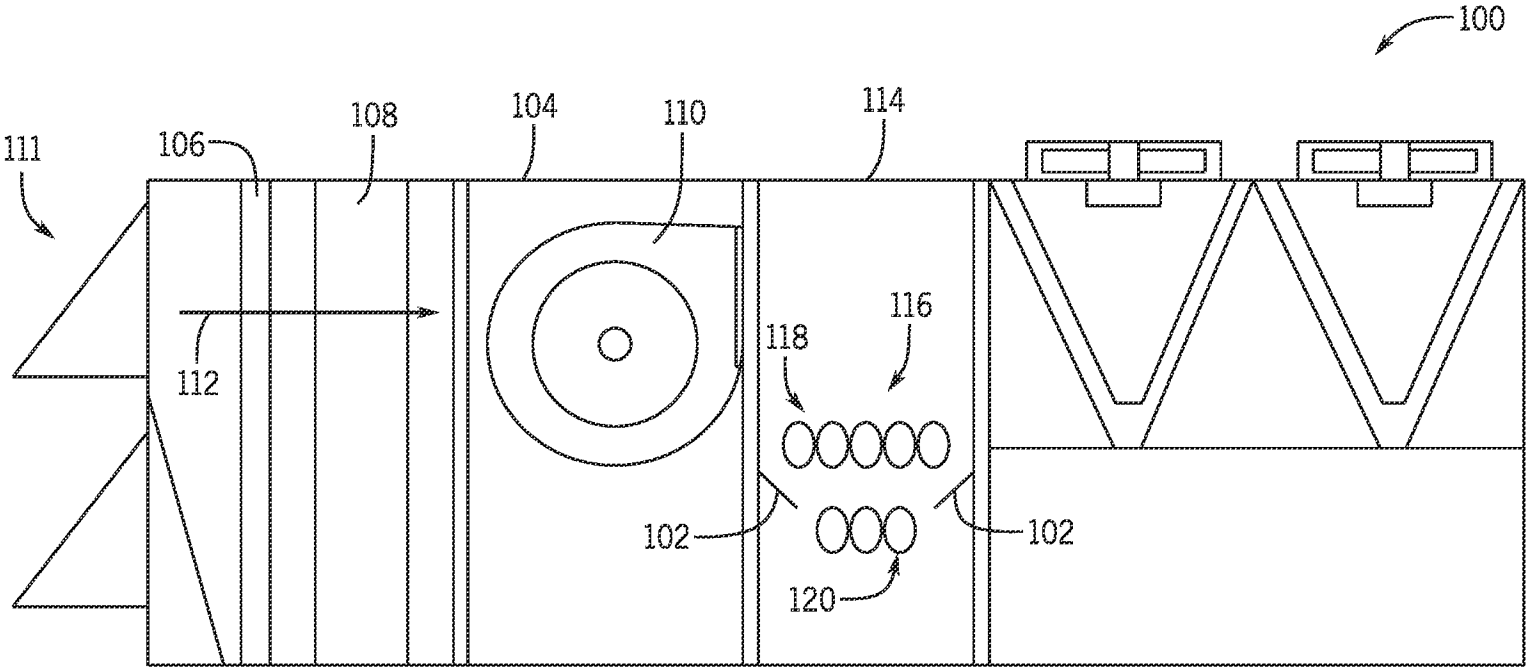
FIG. 5 is a schematic of an embodiment of an HVAC unit having heat exchanger tubes and baffles, in accordance with an aspect of the present disclosure.

FIG. 5 is a schematic of an embodiment of an HVAC unit 100. In some embodiments, the HVAC unit 100 may be implemented in the building 10 to condition an air flow and supply the conditioned air flow throughout the building 10. For example, the HVAC unit 100 may be similar to the HVAC unit 12 and may include components similarly described above with reference to the vapor compression system 72 to condition the air flow. In some embodiments, the HVAC unit 100 includes baffles 102 disposed therein and configured to direct the air flow through the HVAC unit 100, in accordance with the present techniques. The illustrated HVAC unit 100 includes a housing 104 that contains various components, including a filter 106, an evaporator 108, and a blower 110. The blower 110 may draw an air flow into the housing 104 via an intake section 111 of the HVAC unit 100. The blower 110 directs the air flow across the filter 106 and the evaporator 108, as indicated by arrow 112. The air flow is then forced into a heating section 114 of the HVAC unit 100, which may be a plenum, chamber, or other volume of the housing 104. The heating section 114 includes a furnace 116 having heat exchanger tubes. Particularly, the furnace 116 has a first set of heat exchanger tubes 118 and a second set of heat exchanger tubes 120. The heating section 114 also includes the baffles 102, which are configured to direct the air flow across the furnace 116, and more particularly across the second set of heat exchanger tubes 120, before the air flow is discharged from the HVAC unit 100. The configuration and operation of the baffles 102 are described in further detail below. Additionally, it should be appreciated that the baffles 102 disclosed herein may be utilized with other sections or portions of an HVAC system other than the heating section 114.

Figure 6:
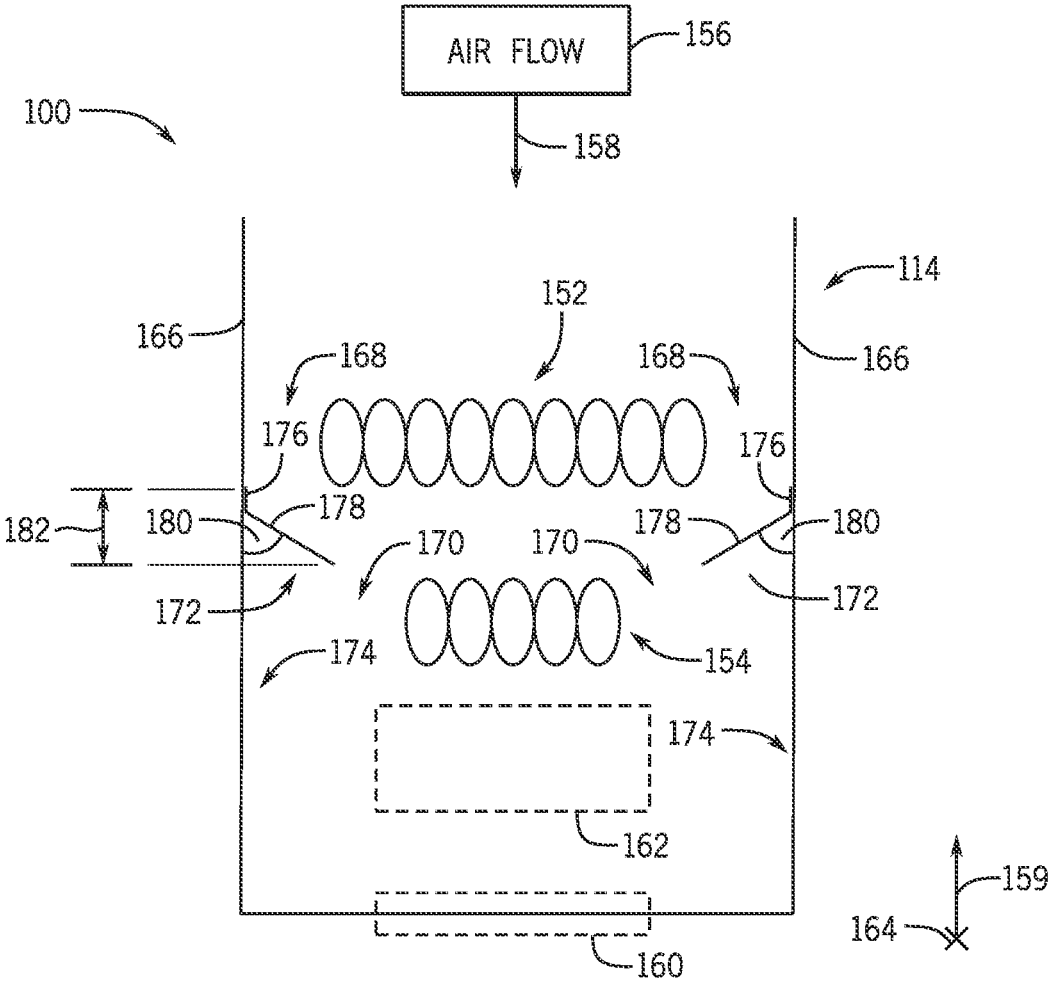
FIG. 6 is a schematic of an embodiment of a section of an HVAC system having heat exchanger tubes and baffles, in accordance with an aspect of the present disclosure.

FIG. 6 is a schematic of an embodiment of the heating section 114 of the HVAC system 100. For example, the heating section 114 may be a portion of the HVAC unit 12, the residential heating and cooling system 50, or any other suitable HVAC system configured to condition an air flow. The heating section 114 includes a first set of heat exchanger tubes 152 and a second set of heat exchanger tubes 154, and an air flow 156 may be directed through the heating section 114 across the first and second sets of heat exchanger tubes 152, 154. In some embodiments, the first and second sets of heat exchanger tubes 152, 154 may each be components of a furnace that configured to heat the air flow 156 within the heating section 114. As an example, a working fluid, such as combustion products, may circulate through the first and second sets of heat exchanger tubes 152, 154. Furthermore, the air flow 156 may be directed in a flow direction 158 of an air flow path, such as along a vertical axis 159, so as to flow across the first and second sets of heat exchanger tubes 152, 154. As a result, heat may be transferred from the combustion products to the air flow 156 passing across the first and second sets of heat exchanger tubes 152, 154, thereby heating the air flow 156.

In some implementations, the heating section 114 may have a first opening 160, such as a bottom discharge opening, through which the air flow 156 may be discharged from the heating section 114 along the vertical axis 159. Additionally or alternatively, the heating section 114 may have a second opening 162, such as a side discharge opening, through which the air flow 156 may be discharged from the heating section 114 along a lateral axis 164. For instance, the heating section 114 may also be a discharge section of the HVAC system 100, and the air flow 156 may be a supply air flow. The first opening 160 and/or the second opening 162 may therefore discharge the air flow 156 toward a space, such as a room of a structure, conditioned by the HVAC system 100. By way of example, the first and second sets of heat exchanger tubes 152, 154 may heat the air flow 156 to a comfortable or desirable temperature, and the air flow 156 may be discharged to the space to condition the space. In additional or alternative embodiments, the heating section 114 may be another suitable section of the HVAC system 100, and the first opening 160 and/or the second opening 162 may discharge the air flow 156 to another part of the HVAC system 100, such as into ductwork and/or a different section of the HVAC system 100 for further conditioning of the air flow 156.

The first and second sets of heat exchanger tubes 152, 154 may be positioned in a series arrangement relative to the flow direction 158 of the air flow 156 through the heating section 114. Therefore, as the air flow 156 is directed through the air flow path, the air flow 156 may be heated by the first set of heat exchanger tubes 152 and then by the second set of heat exchanger tubes 154. In addition, the heating section 114 may include walls 166, such as lateral or side walls, to enclose the first and second sets of heat exchanger tubes 152, 154 and define the air flow path. That is, the walls 166 may generally direct the air flow 156 across the first set of heat exchanger tubes 152 and then across the second heat exchanger tubes 154. By way of example, the air flow 156 may flow across the first set of heat exchanger tubes 152 and/or through first gaps 168 formed between the first set of heat exchanger tubes 152 and the walls 166. The air flow 156 may then flow across the second set of heat exchanger tubes 154 and/or through second gaps 170 formed between the second set of heat exchanger tubes 154 and the walls 166. The air flow 156 may then be discharged out of the heating section 114 via the first and/or second openings 160, 162.

In some circumstances, the air flow 156 may flow from the first gaps 168 directly toward the second gaps 170. In other words, a portion of the air flow 156 may not flow toward and across the second set of heat exchanger tubes 154. Accordingly, the heating section 114 includes deflector baffles 172 configured to direct the air flow 156 from the first set of heat exchanger tubes 152 toward the second set of heat exchanger tubes 154. Thus, the air flow 156 may flow across, rather than bypass, the second set of heat exchanger tubes 154. By way of example, the deflector baffles 172 may be positioned between the first and second sets of heat exchanger tubes 152, 154, such as downstream of the first gaps 168 and upstream of the second gaps 170 with respect to the flow direction 158. In this way, the deflector baffles 172, the first set of heat exchanger tubes 152, and the second set of heat exchanger tubes 154 may be offset from one another along the flow direction 158.

In some embodiments, each of the deflector baffles 172 may be coupled to a respective inner surface 174 of one of the walls 166. For example, each deflector baffle 172 may have a respective flange 176 configured to couple to one of the inner surfaces 174, such as via a mechanical fastener, a weld, an adhesive, a tab, a hook, another suitable method, or any combination thereof. Each flange 176 may be coupled to one of the walls 166 adjacent to one of the first gaps 168, and each deflector baffle 172 may also have a deflecting surface 178 extending from the respective flange 176 of the deflector baffle 172. As such, the deflector baffles 172 may partially block the second gaps 170 along the flow direction 158. Further, the deflecting surfaces 178 may be angled at a respective acute angle 180 relative to the walls 166 such that the deflecting surfaces 178 extend partially in a downstream direction toward the second set of heat exchanger tubes 154. Therefore, the acute angle 180 may be based on an arrangement or position of the first set of heat exchanger tubes 152 and/or the second set of heat exchanger tubes 154 within the air flow path. For example, a magnitude of the acute angle 180 may be selected based on a distance between the first and second set of heat exchanger tubes 152, 154, a position of the first set of heat exchanger tubes 152 relative to the walls 166, a position of the second set of heat exchanger tubes 154 relative to the walls 166, and the like. By way of example, each acute angle 180 may be between 30 degrees and 80 degrees, such as 45 degrees or 60 degrees, so as to guide the air flow 156 from the first gaps 168 toward the second set of heat exchanger tubes 154. As a result, a greater portion of the air flow 156 may flow across the second set of heat exchanger tubes 154. In this way, the deflector baffles 172 may increase an amount of the air flow 156 heated by the second set of heat exchanger tubes 154. In the illustrated embodiment, the deflecting surfaces 178 are generally flat or planar, but in additional or alternative embodiments, the deflecting surfaces 178 may each have a different, suitable geometry, such as a curved or a step-like shape.

In FIG. 6, the first and second sets of heat exchanger tubes 152, 154 are approximately centered between the walls 166. Thus, the heating section 114 may have two deflector baffles 172 that are similar or approximately identical in shape and that are positioned on opposite sides of the air flow path to direct and distribute the air flow 156 across the second set of heat exchanger tubes 154. In additional or alternative embodiments, the first and/or second sets of heat exchanger tubes 152, 154 may be positioned in another manner within the heating section 114. For instance, the first and second sets of heat exchanger tubes 152, 154 may be positioned offset with one another and/or off center between the walls 166. As a result, the heating section 114 may have a different number of deflector baffles 172 and/or the deflector baffles 172 may be positioned in a different manner within the heating section 114 to direct the air flow 156 in a suitable manner across the second set of heat exchanger tubes 154. Moreover, in certain embodiments, the first set of heat exchanger tubes 152 has a different number of heat exchanger tubes as that of the second set of heat exchanger tubes 154. In an example, the first set of heat exchanger tubes 152 has nine heat exchanger tubes, and the second set of heat exchanger tubes 154 has five heat exchanger tubes. Further still, although the heating section 114 includes deflector baffles 172 positioned between the first and second sets of heat exchanger tubes 152, 154 in the illustrated embodiment, in additional or alternative embodiments, the heating section 114 may include deflector baffles 172 positioned upstream of the first set of heat exchanger tubes 152 so as to partially block the first gaps 168 and to guide the air flow 156 across the first set of heat exchanger tubes 152. Thus, the deflector baffles 172 may increase an amount of heat exchanged between the air flow 156 and the refrigerant flowing through the first set of heat exchanger tubes 152.

Figure 7:
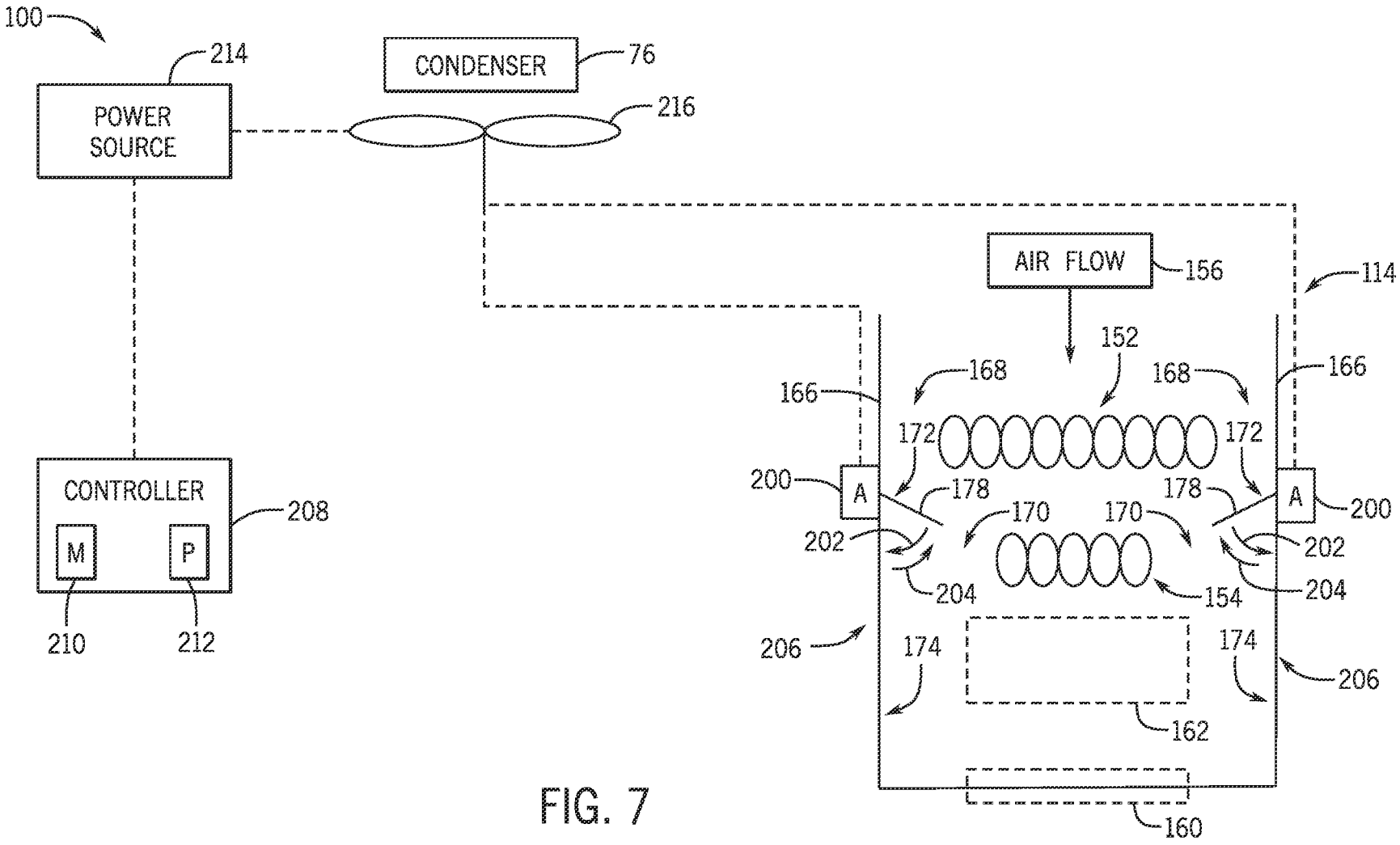
FIG. 7 is a schematic of an embodiment of a section of an HVAC system having heat exchanger tubes, baffles, and a controller configured to actuate the baffles, in accordance with an aspect of the present disclosure.

FIG. 7 is a schematic of an embodiment of the heating section 114 having deflector baffles 172 that are adjustable within the heating section 114. By way of example, the deflector baffles 172 may be actuated based on an operating status of the first and/or second sets of heat exchanger tubes 152, 154. For instance, if the second set of heat exchanger tubes 154 are in operation, such as during a heating mode or reheating mode of the HVAC system 100, the deflector baffles 172 may be in a first or deployed position within the air flow path. That is, in the deployed position, the deflector baffles 172 extend from the walls 166 toward the second set of heat exchanger tubes 154, as illustrated in FIG. 7, thereby overlapping with the second gaps 170 in the flow direction 158 and at least partially blocking air flow through the second gaps 170 in the flow direction 158. Thus, while the second set of heat exchanger tubes 154 are in operation to heat the air flow 156, the deflector baffles 172 direct the air flow 156 across the second set of heat exchanger tubes 154 so as to increase an amount of heat exchanged between the air flow 156 and the working fluid flowing through the second set of heat exchanger tubes 154.

However, if the second set of heat exchanger tubes 154 are not in operation, such as during a cooling mode of the HVAC system 100, the deflector baffles 172 may be moved to a second or retracted position. In the second position, the deflector baffles 172 may extend along, or may be oriented substantially parallel with, the walls 166 instead of extending away from the walls 166. As such, the deflector baffles 172 do not block the second gaps 170 in the second position. Therefore, the air flow 156 may flow through the second gaps 170 generally unimpeded. In other words, the air flow 156 may flow from the first gaps 168 to the second gaps 170 without being directed across the second set of heat exchanger tubes 154. For this reason, the air flow 156 may be discharged from the heating section 114 at a higher flow rate while the deflector baffles 172 are in the second position as compared to when the deflector baffles 172 are in the first or deployed position. When the second set of heat exchanger tubes 154 are not in operation, moving the deflector baffles 172 to the second position may increase an efficiency of the HVAC system 100 directing the air flow 156 through the heating section 114. For example, the blower 110 or another component forcing the air flow 156 through the heating section 114 may operate at a lower operating mode to achieve a desired flow rate of the air flow 156 through the heating section 114, thereby reducing a cost associated with operating the HVAC system 100.

Each of the deflector baffles 172 may be coupled to a respective actuator 200 configured to actuate one of the deflector baffles 172. For example, when the actuators 200 receive power, such as electrical power, the actuators 200 may impart a force to move the deflector baffles 172 in a first direction 202 to the retracted position along the walls 166. In some embodiments, each deflector baffle 172 may have a hinge configured to pivotably couple the deflecting surface 178 to the wall 166. The hinge may enable the deflecting surface 178 to rotate relative to the wall 166 in the first direction 202 to the retracted position. When power is interrupted, such that the actuators 200 do not receive power, the actuators 200 may not impart a force on the deflector baffles 172, and the deflector baffles 172 may move in a second direction 204, such as about the hinge, to the deployed position. For example, a biasing element, such as a spring, may be positioned between the deflector baffles 172 and the walls 166 to bias the deflector baffles 172 toward the deployed position when the actuators 200 are not powered to retract the deflector baffles 172.

In the illustrated embodiment, the actuators 200 are positioned outside of the heating section 114, such as against an outer surface 206 of the walls 166, rather than within the heating section 114 between the walls 166. Thus, the actuators 200 are positioned outside of the air flow path and do not impede a flow of the air flow 156. To this end, the actuators 200 may include a mechanism, such as a linkage system, that extends through the walls 166 so as to couple to the deflector baffles 172. In additional or alternative embodiments, the actuators 200 may be positioned in any suitable position to operate the deflector baffles 172, such as against the inner surfaces 174 of the walls 166.

In some embodiments, the HVAC system 100 may include a controller 208 configured to enable the actuators 200 to move the deflector baffles 172. The controller 208 may have a memory 210 and a processor 212. The memory 210 may be a mass storage device, a flash memory device, removable memory, or any other non-transitory computer-readable medium that includes instructions for the processor 212 to execute. The memory 210 may also include volatile memory such as randomly accessible memory (RAM) and/or non-volatile memory such as hard disc memory, flash memory, and/or other suitable memory formats. The processor 212 may execute the instructions stored in the memory 210, such as operation of the HVAC system 100 in various operating modes. In the illustrated embodiment, the controller 208 is communicatively coupled to a power source 214, which may be configured to supply power to various components of the HVAC system 100. For example, the controller 208 is configured to output a signal to the power source 214, which may be configured to transmit electrical power upon receiving the signal. By way of example, the power source 214 may be electrically coupled to a fan 216 of the condenser 76 of the HVAC system 100 and to the actuators 200. Thus, the power source 214 may provide electrical power to the fan 216 to direct air across the condenser 76 and cool refrigerant flowing through the condenser 76 and/or to the actuators 200 to move the deflector baffles 172 to the second or retracted position.

The fan 216 and the actuators 200 may be electrically coupled in series with the power source 214. In other words, the electrical power provided by the power source 214 may flow to the fan 216 and then to the actuators 200, as shown in FIG. 7, or alternatively, the electrical power may flow to the actuators 200 and then to the fan 216. As a result, when the controller 208 transmits the signal to the power source 214, both the fan 216 and the actuators 200 may be activated. Conversely, when the controller 208 does not transmit the signal to the power source 214, neither the fan 216 nor the actuators 200 may be activated. For example, in a first mode of the HVAC system 100, it may be desirable to cool refrigerant flowing through the condenser 76. After the refrigerant is cooled at the condenser 76, the cooled refrigerant may be placed in a heat exchange relationship with the air flow 156 at another section of the HVAC system 100 so as to cool the air flow 156. Thus, the first mode may be a cooling mode of the HVAC system 100. However, in the first mode, it may not be desirable to heat the air flow 156. Therefore, a working fluid may not flow through the first and second sets of heat exchanger tubes 152, 154. In other words, the first and second sets of heat exchanger tubes 152, 154 may not be operational in the first mode, and it therefore may not be desirable to direct the air flow 156 across the second set of heat exchanger tubes 154 due to fluidic restrictions imposed on the air flow 156 by the non-operating second set of heat exchanger tubes 154. For this reason, in the first mode, the controller 208 enables the power source 214 to provide power to operate the fan 216 to cool the refrigerant in the condenser 76 and to operate the actuators 200 to move the deflector baffles 172 in the first direction 202 to the retracted position. As such, the refrigerant may cool the air flow 156 and the air flow 156 may be directed through the heating section 114 at a greater flow rate in the first mode.

In a second mode of the HVAC system 100, it may not be desirable to cool the refrigerant flowing through the condenser 76 and/or it may be desirable to heat the air flow 156 with a working fluid flowing through the first and second sets of heat exchanger tubes 152, 154. Thus, in the second mode, it may be desirable to increase an amount of the air flow 156 directed across the second set of heat exchanger tubes 154 to increase heating of the air flow 156. Thus, the second mode may be a heating mode of the HVAC system 100, in which electrical power is not supplied to either the fan 216 or the actuators 200. That is, in the second mode, the power source 214 does not provide power to the fan 216 or the actuators 200, and therefore neither the fan 216 nor the actuators 200 are in operation. As a result, the condenser 76 is not operated, and the deflector baffles 172 move to the deployed position to direct the air flow 156 across the second set of heat exchanger tubes 154 in order to heat the air flow 156 via the working fluid flowing through the second set of heat exchanger tubes 154. In this way, the deflector baffles 172 increase heating of the air flow 156 in the second mode.

By placing the fan 216 and the actuators 200 electrically in series, the controller 208 may transmit a single signal to the power source 214 to configure the operating mode of the HVAC system 100, rather than transmitting separate signals to operate the fan 216 and the actuators 200 independently of one another. By way of example, in the first mode, the controller 208 may transmit the single signal to the power source 214, thereby enabling the fan 216 to operate to cool refrigerant within the condenser 76 and enabling the actuators 200 to retract the deflector baffles 172 and increase the flow rate of the air flow 156 through the heating section 114. Further, in the second mode, the controller 208 may not transmit the signal to the power source 214, thereby suspending operation of the fan 216 and of the actuators alternative embodiments, the actuators 200 may be placed in series with another component of the HVAC system 100, such as of a compressor, an evaporator, an expansion device, or any other suitable component configured to operate differently and/or in conjunction with the actuators 200 in various modes of the HVAC system 100. Thus, the actuators 200 may be actuated according to another operating parameter or status indicative of the particular operating mode of the HVAC system 100.

Figure 8:
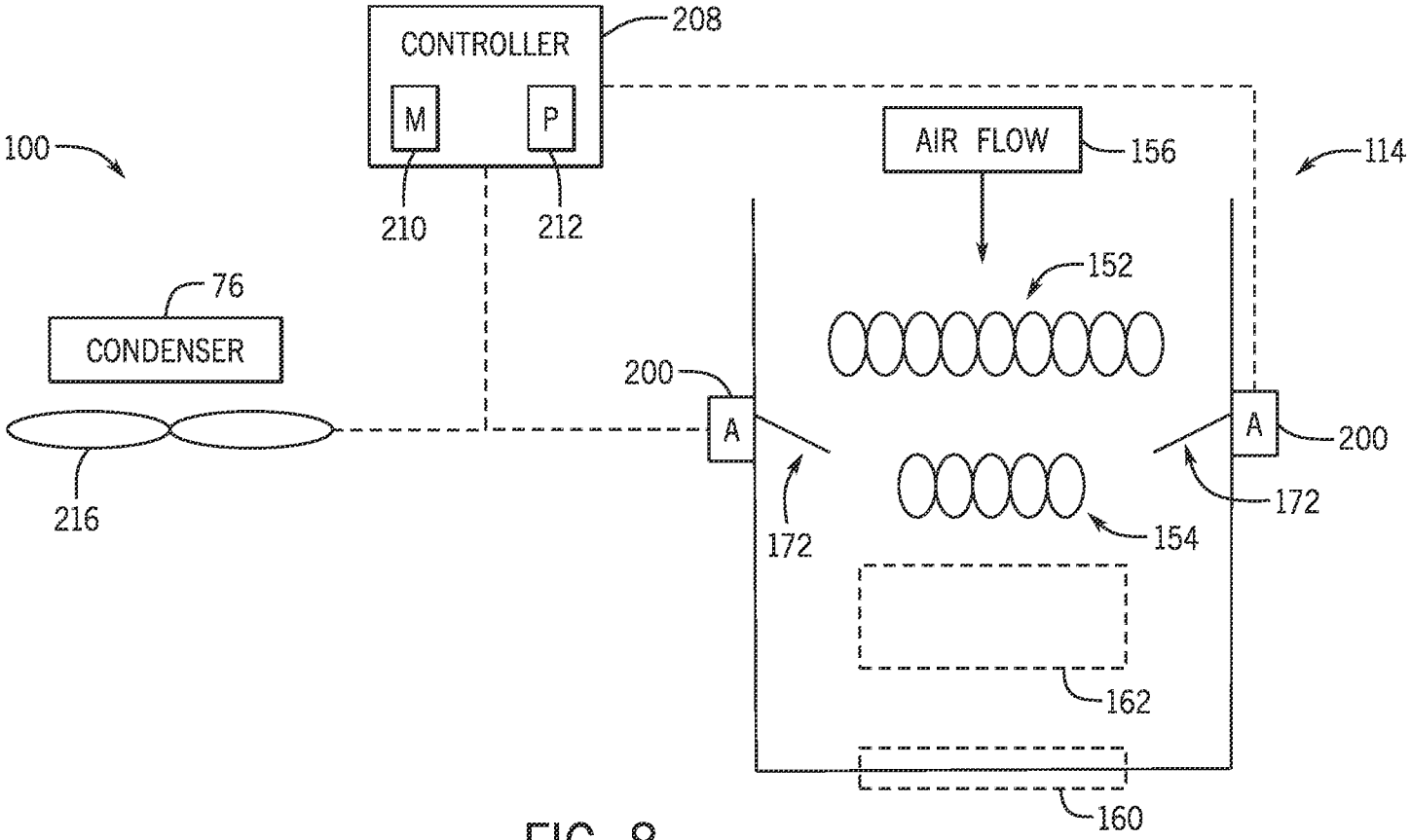
FIG. 8 is a schematic of an embodiment of a section of an HVAC system having heat exchanger tubes, baffles, and a controller configured to actuate the baffles, in accordance with an aspect of the present disclosure.

FIG. 8 is a schematic of an embodiment of the heating section 114 having the deflector baffles 172 configured to move within the heating section 114, illustrating the controller 208 as directly communicatively coupled with the actuators 200 to move the deflector baffles 172. That is, the controller 208 may be configured to transmit respective signals to the actuators 200 to control the actuators 200 independently of other components of the HVAC system 100. For instance, in the first mode, the controller 208 may transmit respective signals to the actuators 200 to move the deflector baffles 172 to the retracted position, thereby enabling an increase in the flow rate of the air flow 156 through the heating section 114. The controller 208 may also transmit a separate signal to the fan 216 to cool the refrigerant within the condenser 76. In the second mode, the controller 208 may not transmit the signals to the actuators 200, and the deflector baffles 172 may move to the deployed position, thereby increasing an amount of the air flow 156 directed across the second set of heat exchanger tubes 154. Further, the controller 208 may transmit a separate signal to the fan 216 to suspend operation of the fan 216.

Moreover, the controller 208 may be configured to operate the HVAC system 100 in other modes. For example, in a third mode, the controller 208 may transmit a signal to the fan 216 to operate the fan 216 and cool refrigerant flowing through the condenser 76, and the controller 208 may not transmit signals to the actuators 200. Therefore, the deflector baffles 172 may move to the deployed position and direct the air flow 156 across the second set of heat exchanger tubes 154 in the third mode. As an example, the third mode may be a reheat mode, in which the air flow 156 may be initially cooled, so as to remove moisture from the air flow 156, and may then be heated to a target temperature level. Thus, the controller 208 may operate the fan 216 to cool the refrigerant flowing through the condenser 76 so as to provide cooling for the air flow 156 with the refrigerant, such as at an evaporator of the HVAC system 100. The controller 208 may also operate the actuators 200 to deploy the deflector baffles 172, instead of retract the deflector baffles 172, so as to direct the air flow 156 across the second set of heat exchanger tubes 154 in order to provide greater heating of the air flow 156 via the working fluid flowing through the second set of heat exchanger tubes 154. In this manner, the controller 208 may be configured to operate the actuators 200, the fan 216, and/or other components of the HVAC system 100 independently of one another and enable greater conditioning of the air flow 156.

Figure 9:
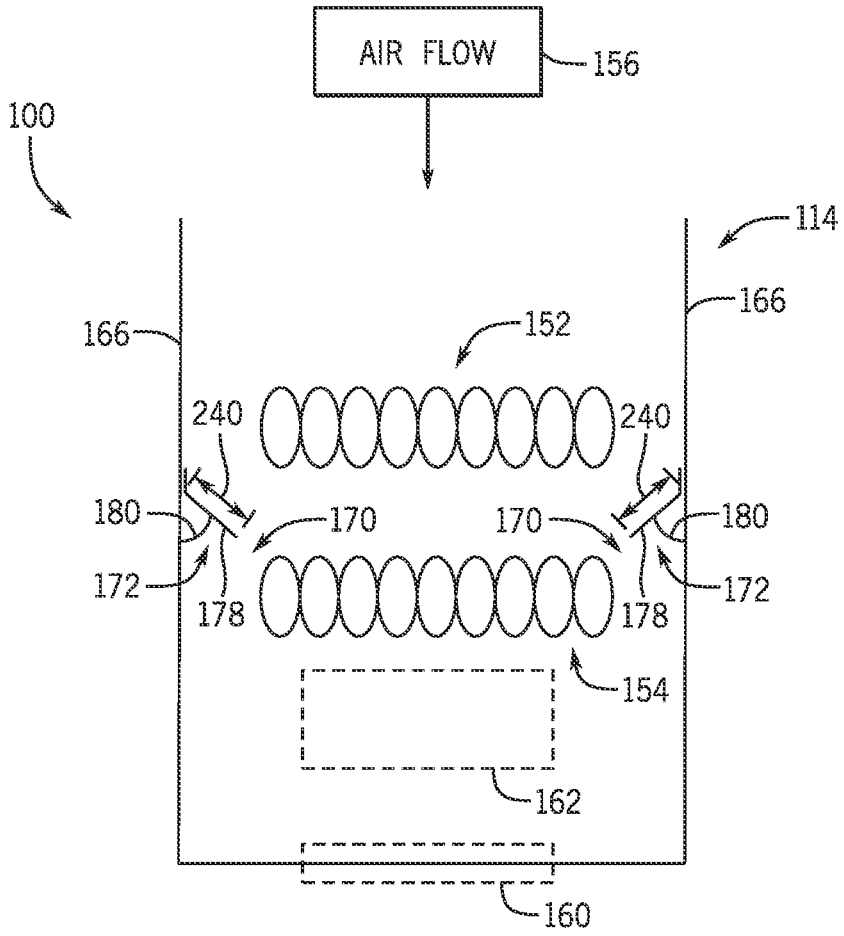
FIG. 9 is a schematic of an embodiment of a section of an HVAC system having heat exchanger tubes and baffles, in accordance with an aspect of the present disclosure.

FIG. 9 is a schematic of an embodiment of the heating section 114 in which the first and second sets of heat exchanger tubes 152, 154 have the same number of heat exchanger tubes. In the illustrated embodiment, the first and second sets of heat exchanger tubes 152, 154 each have nine heat exchanger tubes, but in additional or alternative embodiments, the first and second sets of heat exchanger tubes 152, 154 may have any other suitable number of heat exchanger tubes. Since the number of heat exchanger tubes is greater in the second set of heat exchanger tubes 154 of FIG. 9 as compared to that of the second set of heat exchanger tubes 154 of FIG. 6, the second set of heat exchanger tubes 154 is positioned more proximate to the walls 166. Therefore, the size of the second gaps 170 of FIG. 9 may be smaller relative to the size of the second gaps 170 of FIG. 6.

As mentioned above, the orientation of the deflector baffles 172 may be based on the number of tubes of the second set of heat exchanger tubes 154 to enable a desired distribution of the air flow 156 across the second set of heat exchanger tubes 154. In some embodiments, a respective length 240 of each deflecting surface 178 of the deflector baffles 172 and/or a magnitude of the acute angles 180 may be reduced to accommodate the second set of heat exchanger tubes 154 positioned more proximate to the walls 166. Additionally or alternatively, the respective lengths 240 may be based on the respective acute angles 180. For example, the length 240 may be approximately 23 centimeters or 9 inches based on the acute angle being 30 degrees, approximately 15 centimeters or 6 inches based on the acute angle being 45 degrees, approximately 6.5 centimeters or 2.5 inches based on the acute angle being 60 degrees, or the like. Thus, the length 240 may be based on the orientation of the first and/or second sets of heat exchanger tubes 152, 154 within the air flow path. In further embodiments, a position of the deflector baffles 172 within the heating section 114 relative to the first and second sets of heat exchanger tubes 152, 154 may be based on the orientation of the second set of heat exchanger tubes 154. In any case, the orientation of the deflector baffles 172 may be designed and/or selected in order to guide the air flow 156 effectively from the first set of heat exchanger tubes 152 toward the second set of heat exchanger tubes 154.

Figure 10:
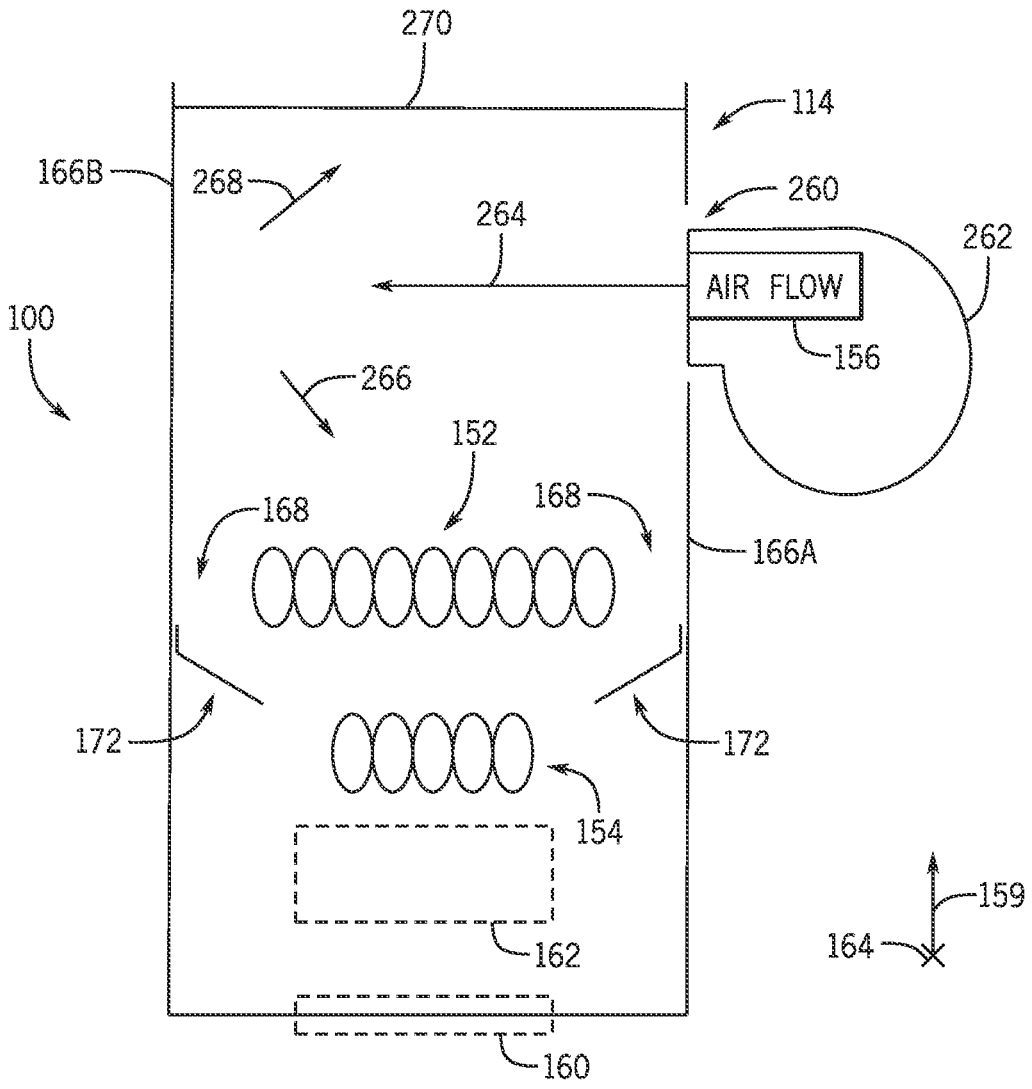
FIG. 10 is a schematic of an embodiment of a section of an HVAC system having heat exchanger tubes and baffles in a side discharge configuration, in accordance with an aspect of the present disclosure.

FIG. 10 is a schematic of an embodiment of the heating section 114 having a side discharge configuration. For example, a first wall 166A of the heating section 114 may have an opening 260 through which the air flow 156 is directed. In the illustrated embodiment, a blower 262 of the HVAC system 100 is configured to force or draw the air flow 156 through the opening 260 toward a second wall 166B of the heating section 114 in a first flow direction 264, which may be crosswise to the vertical axis 159 and/or the lateral axis 164. That is, the first wall 166A may be opposite the second wall 166B, and the first flow direction 264 may be transverse, such as approximately perpendicular, to the second wall 166B. Thus, at least a portion of the air flow 156 directed into the heating section 114 may deflect off the second wall 166B. As an example, a first portion of the air flow 156 may deflect off the second wall 166B generally toward the first and second sets of heat exchanger tubes 152, 154 in a second flow direction 266. The first portion of the air flow 156 may flow across the first set of heat exchanger tubes 152 and/or further deflect off the first wall 166A within the heating section 114. Moreover, a second portion of the air flow 156 may deflect off the second wall 166B generally away from the first and second set of heat exchanger tubes 152, 154, such as in a third flow direction 268 toward a panel 270, such as a top panel, of the heating section 114. The second portion of the air flow 156 may then deflect off the panel 270 toward the first and second sets of heat exchanger tubes 152, 154. In any case, in the heating section 114 having the side discharge configuration, the air flow 156 may deflect off different surfaces, walls, and/or panels of the heating section 114 before flowing toward the first and second set of heat exchanger tubes 152, 154.

In any case, in the side discharge configuration, the air flow 156 may not flow directly toward the first set of heat exchanger tubes 152. However, regardless of the direction of flow of the air flow 156 through the heating section 114, the deflector baffles 172 may effectively guide the air flow 156 from the first set of heat exchanger tubes 152 to the second set of heat exchanger tubes 154. For instance, the deflector baffles 172 direct the air flow 156 from the first gaps 168 toward the second set of heat exchanger tubes 154. In this way, the deflector baffles 172 may increase the heating of the air flow 156. After the air flow 156 passes across the second set of heat exchanger tubes 154, the air flow 156 may be discharged from the heating section 114 via the first opening 160 or the second opening 162.

The present disclosure may provide one or more technical effects useful in the operation of an HVAC system. For example, the HVAC system may have a section, such as a heating section, through which an air flow is directed. The section may include first and second sets of heat exchanger tubes through which a working fluid may flow, and the air flow may first be directed across the first set of heat exchanger tubes and then across the second set of heat exchanger tubes to exchange heat with the working fluid. Furthermore, the section may include deflector baffles positioned between the first and second sets of heat exchanger tubes. The deflector baffles may be angled so as to guide the air flow from the first set of heat exchanger tubes toward the second set of heat exchanger tubes. In this manner, the deflector baffles may increase an amount of the air flow directed across the second set of heat exchanger tubes, thereby increasing an amount of heat exchanged between the working fluid and the air flow. As a result, the deflector baffles may increase heat transfer efficiency of the HVAC system. It should be noted that the embodiments discussed herein may be retrofitted into existing HVAC systems. In other words, deflector baffles may be implemented into a section, such as a furnace or heating section, of an existing HVAC system to improve air flow and heat transfer within the section. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A furnace for a heating, ventilation, and/or air conditioning (HVAC) system, comprising:

a first set of heat exchanger tubes positioned within an air flow path of the furnace and offset from a wall of the furnace to form a first gap extending laterally between the first set of heat exchanger tubes and the wall;

a second set of heat exchanger tubes positioned within the air flow path of the furnace and offset from the wall of the furnace to form a second gap extending laterally between the second set of heat exchanger tubes and the wall, wherein the second gap is larger than the first gap, wherein the first set of heat exchanger tubes and the second set of heat exchanger tubes are offset from one another relative to a direction of an air flow along the air flow path to form a rectangular-shaped space extending from the first set of heat exchanger tubes to the second set of heat exchanger tubes, and wherein the rectangular-shaped space is without heat exchanger tubes; and a deflector baffle fixedly attached to the wall, the deflector baffle comprises a flange and a deflecting surface, the flange is fixedly attached to the wall, the deflecting surface is bent relative to the flange, the deflecting surface extends away from the wall, and the deflector baffle is positioned entirely within the rectangular-shaped space and configured to direct a portion of the air flow toward the second set of heat exchanger tubes and away from the second gap.

2. The furnace of claim 1, wherein the wall is a first wall, the furnace comprises a second wall, opposite the first wall, and the rectangular-shaped space is laterally bounded by the first wall of the furnace and the second wall of the furnace.

3. The furnace of claim 2, wherein the deflector baffle is a first deflector baffle, and the furnace comprises a second deflector baffle, wherein the first deflector baffle and the second deflector baffle are positioned on opposite sides of the air flow path from one another.

4. The furnace of claim 3, wherein the second deflector baffle is attached to the second wall.

5. The furnace of claim 1, wherein the deflector baffle is rotationally fixed relative to the first set of heat exchanger tubes and the second set of heat exchanger tubes.

6. The furnace of claim 1, wherein the deflector baffle comprises:

an upstream end positioned within the rectangular-shaped space; and a downstream end positioned within the rectangular-shaped space, wherein the deflecting surface extends from the upstream end to the downstream end, wherein the deflector baffle is positioned upstream of the second gap relative to the direction of the air flow along the air flow path.

7. A heating, ventilation, and/or air conditioning (HVAC) system, comprising:

a furnace, comprising:

a first set of heat exchanger tubes positioned within an air flow path of the furnace, wherein the first set of heat exchanger tubes is offset from a first wall of the furnace to form a first gap and offset from a second wall of the furnace to form a second gap;

a second set of heat exchanger tubes positioned within the air flow path of the furnace, wherein the second set of heat exchanger tubes is offset from the first wall of the furnace to form a third gap and offset from the second wall of the furnace to form a fourth gap, each of the third gap and the fourth gap is larger than each of the first gap and the second gap, and the second set of heat exchanger tubes is offset from the first set of heat exchanger tubes along a direction of an air flow directed through the furnace;

a rectangular-shaped space extending from the first set of heat exchanger tubes to the second set of heat exchanger tubes along the direction of the air flow through the furnace, wherein the rectangular-shaped space is laterally bounded by the first wall of the furnace and the second wall of the furnace relative to the direction of the air flow through the furnace, and wherein the rectangular-shaped space is void of heat exchanger tubes; and a deflector baffle comprising a flange directly coupled to the first wall, wherein the deflector baffle is positioned within the rectangular-shaped space and between the first set of heat exchanger tubes and the second set of heat exchanger tubes relative to the direction of the air flow through the furnace.

8. The HVAC system of claim 7, wherein the deflector baffle comprises a deflecting surface contained entirely within the rectangular-shaped space.

9. The HVAC system of claim 7, wherein the deflector baffle forms an acute angle with the first wall, and a magnitude of the acute angle is based on an orientation of the first set of heat exchanger tubes and/or the second set of heat exchanger tubes within the air flow path.

10. The HVAC system of claim 7, wherein the furnace comprises the first wall, the second wall, and a blower, the first wall comprises an opening, and the blower is configured to direct the air flow through the opening and toward the second wall in a second direction crosswise to the direction of the air flow through the furnace.

11. The HVAC system of claim 10, wherein the furnace comprises a third wall, the third wall comprises a discharge opening, and the furnace is configured to discharge the air flow through the discharge opening.

12. The HVAC system of claim 7, wherein the first set of heat exchanger tubes defines an upstream boundary of the rectangular-shaped space relative to the direction of the air flow through the furnace, and the second set of heat exchanger tubes defines a downstream boundary of the rectangular-shaped space relative to the direction of the air flow through the furnace.

13. The HVAC system of claim 7, wherein the rectangular-shaped space extends a lateral dimension from the first wall of the furnace to the second wall of the furnace, relative to the direction of the air flow through the furnace, and the rectangular-shaped space extends between the first set of heat exchanger tubes and the second set of heat exchanger tubes across an entirety of the lateral dimension.

14. A furnace for a heating, ventilation, and/or air conditioning (HVAC) system, comprising:

a first set of heat exchanger tubes offset from a first wall of the furnace and offset from a second wall of the furnace to form a first set of gaps;

a second set of heat exchanger tubes offset from the first wall of the furnace and offset from the second wall of the furnace to form a second set of gaps, wherein the first wall and the second wall are positioned on opposite sides of the furnace, and each gap of the second set of gaps is larger than each gap of the first set of gaps;

a rectangular-shaped space, wherein the first set of heat exchanger tubes defines an upstream boundary of the rectangular-shaped space relative to a direction of an air flow through the furnace, the second set of heat exchanger tubes defines a downstream boundary of the rectangular-shaped space relative to the direction of the air flow through the furnace, the first wall and the second wall define lateral boundaries of the rectangular-shaped space relative to the direction of the air flow through the furnace, and the rectangular-shaped space is without heat exchanger tubes; and a baffle fixedly attached to the first wall and extending from the first wall, wherein the baffle comprises a flange and a deflecting surface, the flange is fixedly attached to the first wall, the deflecting surface is bent relative to the flange, the deflecting surface extends away from the first wall, the baffle is positioned entirely within the rectangular-shaped space, and the baffle is configured to direct a portion of the air flow toward the second set of heat exchanger tubes and away from a gap of the second set of gaps.

15. The furnace of claim 14, wherein the baffle comprises an upstream end attached to the first wall and a downstream end, opposite the upstream end, wherein the downstream end is positioned within the rectangular-shaped space upstream of the second set of heat exchanger tubes, relative to the direction of the air flow through the furnace.

16. The HVAC system of claim 7, wherein the deflector baffle is positioned upstream of the third gap relative to the direction of the air flow through the furnace and configured to redirect the air flow away from the third gap and toward the second set of heat exchanger tubes.

* * * * *